US012084953B2

(12) United States Patent
Taha et al.

(10) Patent No.: US 12,084,953 B2
(45) Date of Patent: Sep. 10, 2024

(54) FRAC ENABLED WEAR BUSHING FOR TUBING HEAD SPOOL

(71) Applicant: SAUDI ARABIAN OIL COMPANY, Dhahran (SA)

(72) Inventors: Syed Muhammad Taha, Dhahran (SA); Amr Mohamed Zahran, Dhahran (SA); Bagus Setiadi, Dhahran (SA); Fatimah AlNasser, Dhahran (SA); Mustafa Karakaya, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/966,367

(22) Filed: Oct. 14, 2022

(65) Prior Publication Data

US 2024/0125221 A1 Apr. 18, 2024

(51) Int. Cl.

| | |
|---|---|
| ***E21B 43/26*** | (2006.01) |
| ***E21B 10/36*** | (2006.01) |
| ***E21B 28/00*** | (2006.01) |
| ***E21B 33/04*** | (2006.01) |
| ***E21B 33/068*** | (2006.01) |

(52) U.S. Cl.

CPC ..... *E21B 43/26* (2013.01); *E21B 33/04* (2013.01)

(58) Field of Classification Search

None

See application file for complete search history.

(56) References Cited

U.S. PATENT DOCUMENTS

| | | | | |
|---|---|---|---|---|
| 4,340,259 | A | 7/1982 | Green | |
| 7,213,641 | B2 * | 5/2007 | McGuire | E21B 33/068 166/177.5 |
| 7,493,944 | B2 | 2/2009 | Duhn et al. | |
| 7,886,833 | B2 | 2/2011 | McGuire et al. | |
| 8,122,949 | B2 | 2/2012 | Cherewyk | |
| 8,327,943 | B2 * | 12/2012 | Borak | E21B 17/1007 166/368 |
| 8,443,898 | B1 * | 5/2013 | McClinton | E21B 17/1007 166/344 |
| 8,528,585 | B2 * | 9/2013 | McGuire | F16L 57/06 285/55 |
| 8,931,551 | B2 * | 1/2015 | McGuire | E21B 43/26 166/177.5 |
| 9,476,262 | B2 | 10/2016 | Benson et al. | |
| 9,540,888 | B2 | 1/2017 | Reimert | |
| 10,151,188 | B2 * | 12/2018 | Kajaria | C09D 5/002 |
| 2004/0251018 | A1 * | 12/2004 | McLeod | E21B 43/2607 166/75.13 |
| 2017/0002620 | A1 * | 1/2017 | Roesner | E21B 43/2607 |
| 2017/0204714 | A1 * | 7/2017 | Roesner | E21B 33/068 |

* cited by examiner

*Primary Examiner* — Matthew R Buck
*Assistant Examiner* — Douglas S Wood
(74) *Attorney, Agent, or Firm* — Osha Bergman Watanabe & Burton LLP

(57) ABSTRACT

A system includes a tubing head, a bushing profile, and a wear bushing. The tubing head is connected to the casing head. The bushing profile is formed by a tubing head inner surface of the tubing head. The wear bushing has a bushing external surface configured to mate with the bushing profile. An orifice is formed by the installation of the wear bushing in the bushing profile and the connection between the tubing head and the casing head.

20 Claims, 5 Drawing Sheets

FRAC ENABLED WEAR BUSHING FOR TUBING HEAD SPOOL

BACKGROUND

Hydrocarbons are located in porous formations far beneath the Earth's surface. Wells are drilled into the porous formations to access and produce the hydrocarbons. In some cases, the porous formations have low permeability meaning that while there is a volume of hydrocarbons available, the hydrocarbons are unable to be produced using conventional methods as the hydrocarbons are unable to migrate out of the formation. In such scenarios, fracturing operations may be performed on the well to increase the permeability of the formation and efficiently produce the hydrocarbons. In fracturing operations, large volumes of frac fluid and proppant (such as sand) are pumped into the well at high pressures. This is an abrasive operation and erodes the conduits used to navigate the frac fluids and proppant into the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for performing a fracturing operation in a well having a casing head. The system includes a tubing head, a bushing profile, and a wear bushing. The tubing head is connected to the casing head. The bushing profile is formed by a tubing head inner surface of the tubing head. The wear bushing has a bushing external surface configured to mate with the bushing profile. An orifice is formed by the installation of the wear bushing in the bushing profile and the connection between the tubing head and the casing head.

In accordance with one or more embodiments, the method includes connecting a tubing head to the casing head. The tubing head comprises a bushing profile formed by a tubing head inner surface. The method also includes installing a wear bushing into the bushing profile of the tubing head and forming an orifice between the tubing head, the casing head, and the wear bushing. The method further includes performing a fracturing operation on the well by pumping a frac fluid into the orifice.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
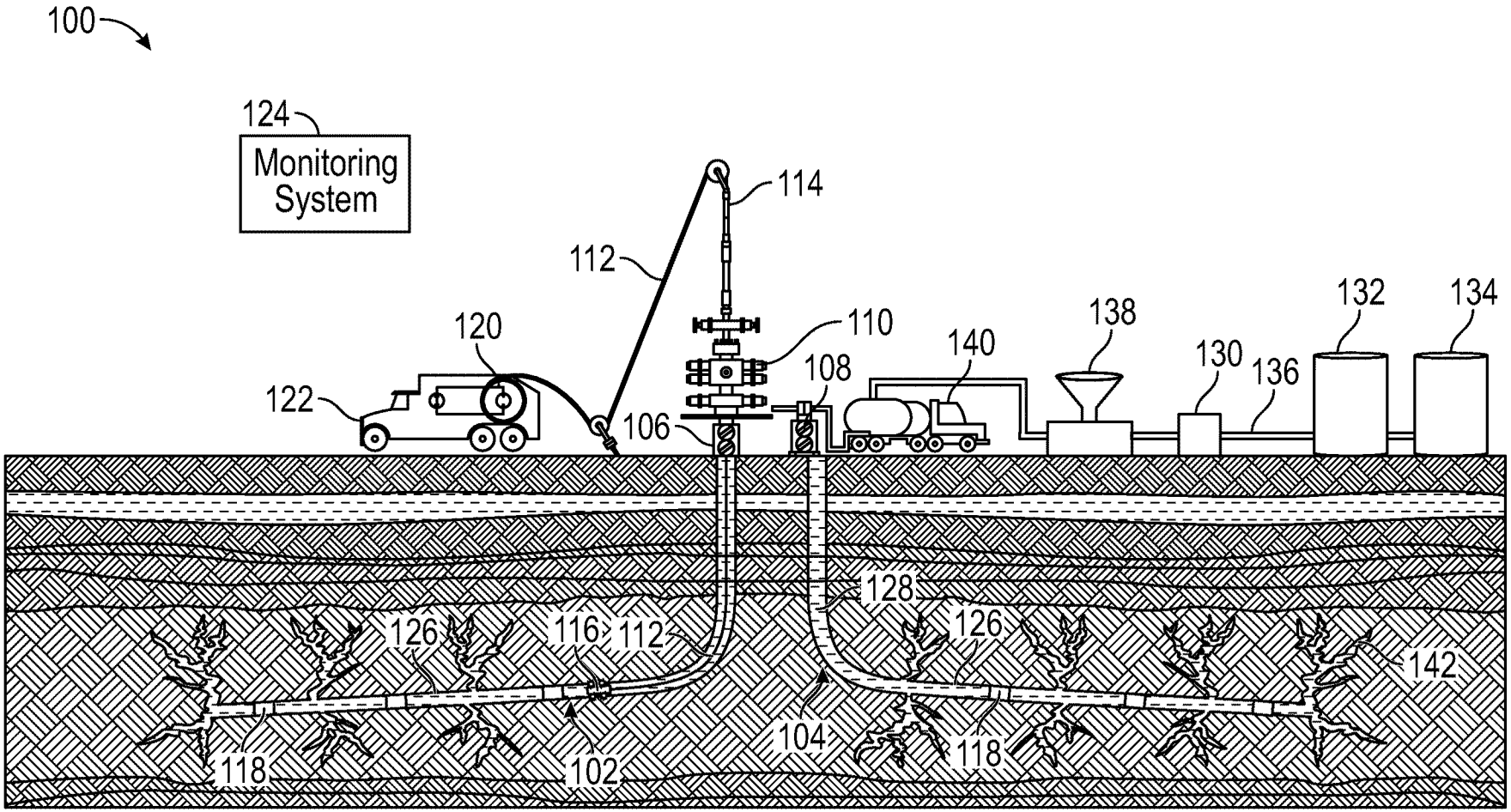
FIG. 1 shows a hydraulic fracturing site undergoing a hydraulic fracturing operation in accordance with one or more embodiments.

FIG. 1 shows a hydraulic fracturing site (100) undergoing a hydraulic fracturing operation in accordance with one or more embodiments. The particular hydraulic fracturing operation and hydraulic fracturing site (100) shown is for illustration purposes only. The scope of this disclosure is intended to encompass any type of hydraulic fracturing site (100) and hydraulic fracturing operation. In general, a hydraulic fracturing operation includes two separate operations: a perforation operation and a pumping operation.

In further embodiments, a hydraulic fracturing operation is performed in stages and on multiple wells that are geographically grouped. A singular well may have anywhere from one to more than forty stages. Typically, each stage includes one perforation operation and one pumping operation. While one operation is occurring on one well, a second operation may be performed on the other well. As such, FIG. 1 shows a hydraulic fracturing operation occurring on a first well (102) and a second well (104). The first well (102) is undergoing the perforation operation and the second well (104) is undergoing the pumping operation.

The first well (102) and the second well (104) are horizontal wells meaning that each well includes a vertical section and a lateral section. The lateral section is a section of the well that is drilled at least eighty degrees from vertical. The first well (102) is capped by a first frac tree (106) and the second well (104) is capped by a second frac tree (108). Those skilled in the art will appreciate that the use of the term "frac" refers to "fracturing," and the term "frac" is used herein to describe elements that may be used in a fracturing operation. A frac tree (106, 108) is similar to a Christmas/production tree, but is specifically installed for the hydraulic fracturing operation. The frac trees (106, 108) tend to have larger bores and higher-pressure ratings than a Christmas/production tree would have. Further, hydraulic fracturing operations require abrasive materials being pumped into the well at high pressures, so the frac tree (106, 108) is designed to handle a higher rate of erosion.

In accordance with one or more embodiments, the first well (102) and the second well (104) each require four stages. Both the first well (102) and the second well (104) have undergone three stages and are undergoing the fourth stage. The second well (104) has already undergone the fourth stage perforation operation and is currently undergoing the fourth stage pumping operation. The first well (102) is undergoing the fourth stage perforating operation and has yet to undergo the fourth stage pumping operation.

In accordance with one or more embodiments, the perforating operation includes installing a wireline blow out preventor (BOP) (110) onto the first frac tree (106). A wireline BOP (110) is similar to a drilling BOP; however, a wireline BOP (110) has seals designed to close around (or shear) wireline (112) rather than drill pipe. A lubricator (114) is connected to the opposite end of the wireline BOP (110). A lubricator (114) is a long, high-pressure pipe used to equalize between downhole pressure and atmosphere pressure in order to run downhole tools, such as a perforating gun (116), into the well.

The perforating gun (116) is pumped into the first well (102) using the lubricator (114), wireline (112), and fluid pressure. In accordance with one or more embodiments, the perforating gun (116) is equipped with explosives and a frac plug (118) prior to being deployed in the first well (102). The wireline (112) is connected to a spool (120) often located on a wireline truck (122). Electronics (not pictured) included in the wireline truck (122) are used to control the unspooling/spooling of the wireline (112) and are used to send and receive messages along the wireline (112). The electronics may also be connected, wired or wirelessly, to a monitoring system (124) that is used to monitor and control the various operations being performed on the hydraulic fracturing site (100).

When the perforating gun (116) reaches a predetermined depth, a message is sent along the wireline (112) to set the frac plug (118). After the frac plug (118) is set, another message is sent through the wireline (112) to detonate the explosives, as shown in FIG. 1. The explosives create perforations in the casing (126) and in the surrounding formation. There may be more than one set of explosives on a singular perforation gun (116), each detonated by a distinct message. Multiple sets of explosives are used to perforate different depths along the casing (126) for a singular stage. Further, the frac plug (118) may be set separately from the perforation operation without departing from the scope of the disclosure herein.

As explained above, FIG. 1 shows the second well (104) undergoing the pumping operation after the fourth stage perforating operation has already been performed and perforations are left behind in the casing (126) and the surrounding formation. A pumping operation includes pumping a frac fluid (128) into the perforations in order to propagate the perforations and create fractures (142) in the surrounding formation. The frac fluid (128) often comprises a certain percentage of water, proppant, and chemicals.

FIG. 1 shows chemical storage containers (130), water storage containers (132), and proppant storage containers (134) located on the hydraulic fracturing site (100). Frac lines (136) and transport belts (not pictured) transport the chemicals, proppant, and water from the storage containers (130, 132, 134) into a frac blender (138). A plurality of sensors (not pictured) are located throughout this equipment to send signals to the monitoring system (124). The monitoring system (124) may be used to control the volume of water, chemicals, and proppant used in the pumping operation.

The frac blender (138) blends the water, chemicals, and proppant to become the frac fluid (128). The frac fluid (128) is transported to one or more frac pumps, often pump trucks (140), to be pumped through the second frac tree (108) into the second well (104). Each pump truck (140) includes a pump designed to pump the frac fluid (128) at a certain pressure. More than one pump truck (140) may be used at a time to increase the pressure of the frac fluid (128) being pumped into the second well (104). The frac fluid (128) is transported from the pump truck (140) to the second frac tree (108) using a plurality of frac lines (136).

The fluid pressure propagates and creates the fractures (142) while the proppant props open the fractures (142) once the pressure is released. Different chemicals may be used to lower friction pressure, prevent corrosion, etc. The pumping operation may be designed to last a certain length of time to ensure the fractures (142) have propagated enough. Further, the frac fluid (128) may have different make ups throughout the pumping operation to optimize the pumping operation without departing from the scope of the disclosure herein.

When the hydraulic fracturing operation is completed on a well, the frac tree (108) must be removed from the well in order to perform the final completion operations which include drilling out the plugs (118) using coiled tubing or a snubbing unit and installing production tubing (not pictured). The production tubing is installed by running the length of production tubing into the well and landing out the tubing hanger (i.e., the surface extending portion of the production tubing that has seals) into a tubing head that caps the well.

The tubing head has a tubing hanger profile that is machined to mate with the tubing hanger to create a fluid tight seal such that production fluid from the formation cannot leak into the environment. As such, it is important to protect the inside, i.e., the tubing hanger profile, of the tubing head from any type of erosion as even the smallest imperfection could cause failure in the seal between the tubing hanger and the tubing head.

As such, hydraulic fracturing operations are conventionally pumped through the frac trees (108) (as described above), and the tubing head is installed after the hydraulic fracturing operation has been completed. However, once a hydraulic fracturing operation is completed, the well is highly pressurized, and a kill fluid must be pumped into the well prior to removal of the frac tree (108).

This is a time-consuming operation and can be dangerous as a well barrier is having to be removed to swap the surface equipment. Further, pumping a kill fluid into a well may damage the formation and create unnecessary skin. Therefore, the ability to perform an erosive hydraulic fracturing operation on a well through the tubing head without damaging the inside of the tubing head is beneficial.

As such, the present disclosure outlines systems and methods that allow a hydraulic fracturing operation to be performed on a well through a tubing head by temporarily installing a wear bushing inside of the tubing head. The wear bushing is designed to handle the erosive properties of the hydraulic fracturing operation and is designed to fit into the tubing hanger profile that already exists in the tubing head.

Figure 2:
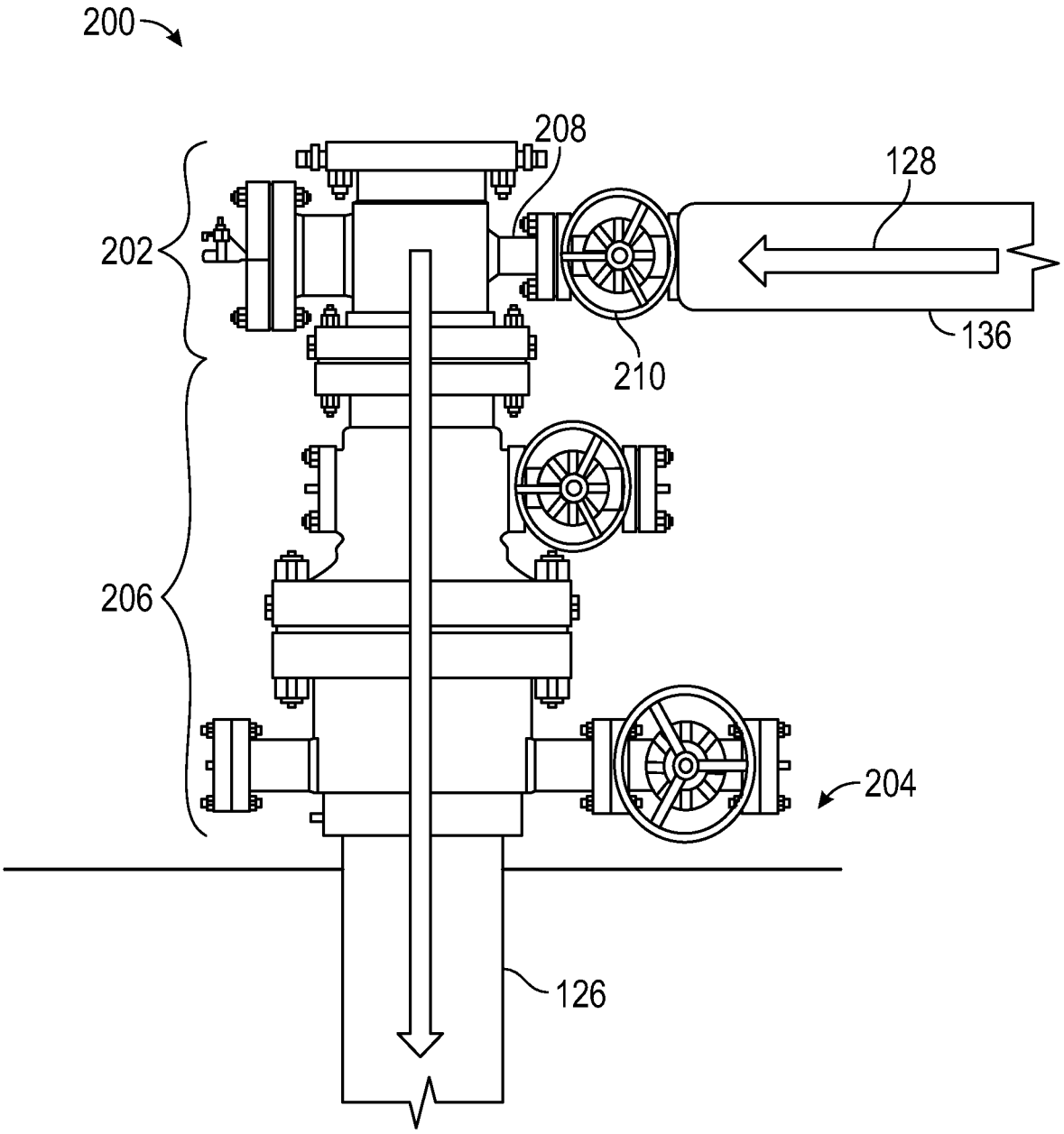
FIG. 2 shows a hydraulic fracturing operation being performed on a well through a tubing head in accordance with one or more embodiments.

FIG. 2 shows a hydraulic fracturing operation being performed on a well (200) through a tubing head (202) in accordance with one or more embodiments. An external view of the well (200) is shown with arrows representing the direction of frac fluid (128) being pumped into the well (200). The hydraulic operation may be similar to the hydraulic operation outlined in FIG. 1. Further, the well (200) may be similar to the first well (102) or the second well (104) outlined in FIG. 1. Components shown in FIG. 2 that have been described in FIG. 1 have not been redescribed for purposes of readability and have the same design and function as outlined above.

The well (200) has at least one casing (126) that is capped at a surface location (204) using a casing head (206). In accordance with one or more embodiments, the casing (126) is a plurality of tubulars threaded together. The tubulars are made out of a durable material, such as steel, and are designed to provide the mechanical support in the downhole portion of the well (200) and are used to isolate various formations from one another and control the production of fluids, such as hydrocarbons, from the formation that is being accessed using the well (200).

The surface location (204) is any location located along the Earth's surface and describes any location that is located on or above the ground. The casing head (206) houses the surface extending portion of the casing (126) which includes a casing hanger (not pictured). The casing hanger is similar to the tubing hanger described above. The casing hanger installed in the casing head (206) provides a fluid-tight seal between the casing (126) and the surface location (204) such that fluids are unable to unintentionally migrate from the formation to the surface location (204).

The tubing head (202) is installed on top of the casing head (206). As explained above, the tubing head (202) is designed to house the tubing hanger (not pictured) of production tubing (not pictured). The tubing head (202) has a wing (208) that extends from the tubing head (202). The wing may have a wing valve (210) installed to control a flow of fluid, such as frac fluid (128), into or out of the tubing head (202). The tubing head (202) may have another valve (not pictured) that is able to prevent fluid from migrating between the casing head (206) and the tubing head (202). The valves may be any valves known in the art such as ball valves, gate valves, etc. Further, the vales may be operated hydraulically or mechanically.

A frac line (136) is connected to the wing (208) of the tubing head (202). The wing (208) and the frac line (136) may be hydraulically connected to the orifice (318) when the wing valve (210) is in the open position. The hydraulic fracturing operation may be performed on the well by pumping the frac fluid (128) into the well (200) using the frac line (136) and the tubing head (202). The hydraulic fracturing operation is able to be performed on the well (200) without damaging the inside of the tubing head (202) due to presence of a wear bushing (300) installed inside of the tubing head (202).

Figure 3:
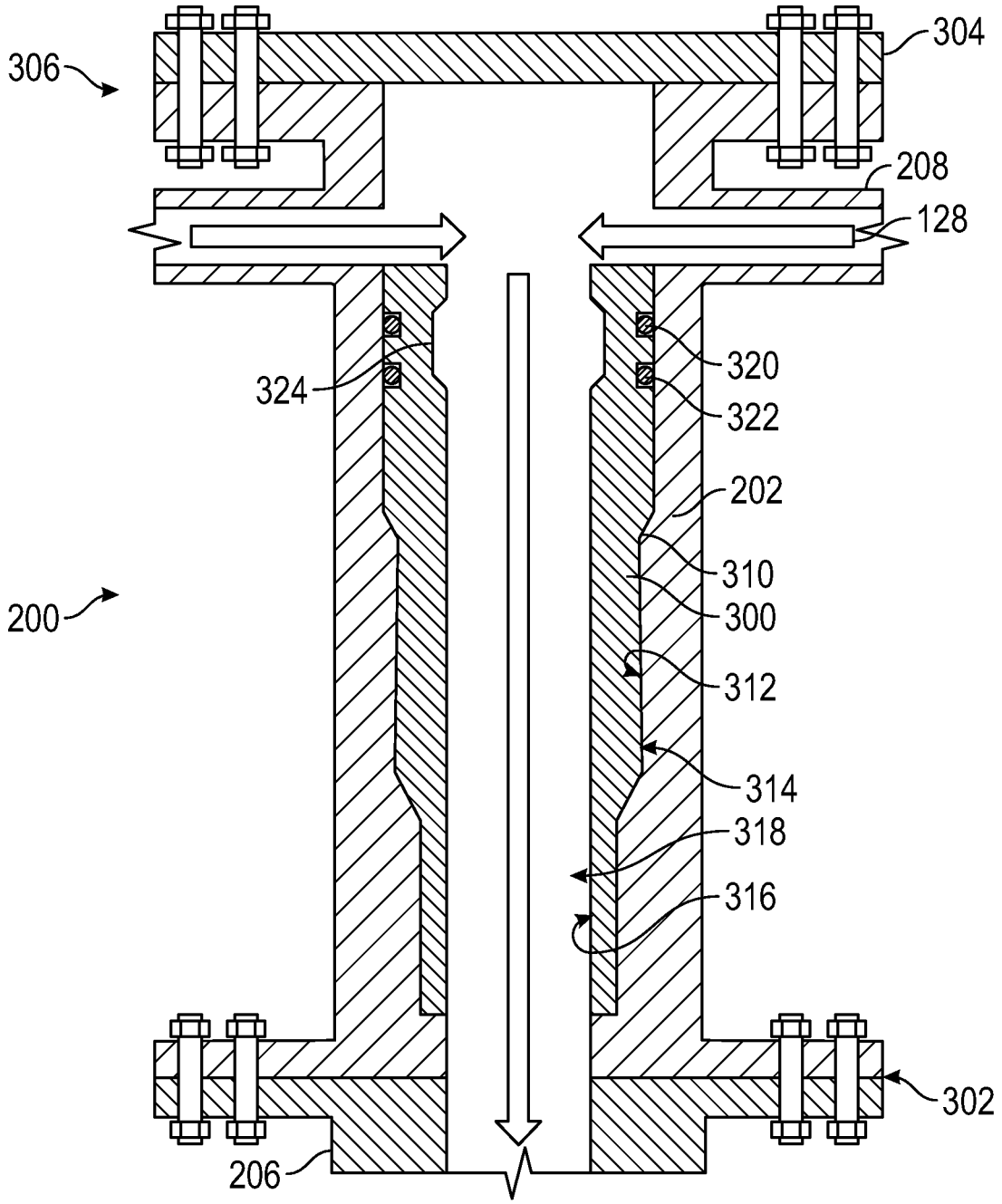
FIG. 3 shows a cross section of the well in accordance with one or more embodiments.

FIG. 3 shows a cross section of the well (200) in accordance with one or more embodiments. Specifically, FIG. 3 shows specifics of the wear bushing (300) and how the wear bushing (300) is installed inside of the tubing head (202). Components shown in FIG. 3 that are the same as or similar to components described in FIGS. 1 and 2 have not been redescribed for purposes of readability and have the same design and function as outlined above.

Initially, FIG. 3 shows how the tubing head (202) may be connected to the casing head (206). The connection between the tubing head (202) and the casing head (206) may be any type of connection known in the art. In particular, FIG. 3 shows a first bolted connection (302) being used to connect the tubing head (202) to the casing head (206).

Further, a cap (304) is used to close the top of the tubing head (202) to the environment. The cap (304) may be connected to the tubing head (202) using any connection known in the art. In particular, FIG. 3 shows a second bolted connection (306) being used to connect the cap (304) to the tubing head (202).

As explained above, the tubing head (202) includes a tubing hanger profile that will be used to land the tubing hanger of the production tubing once the hydraulic fracturing operation is completed. However, in FIG. 3, the tubing hanger profile is being used to land a wear bushing (300). Thus, this profile is called a bushing profile (310) herein, but it should be known that the bushing profile (310) is synonymous to the tubing hanger profile that will be used to land a future casing hanger.

The bushing profile (310) is formed by a tubing head inner surface (312) of the tubing head (202). In accordance with one or more embodiments, the bushing profile (310) is machined into the tubing head inner surface (312) and matches the design of the bushing external surface (314) of the wear bushing (300). When the bushing external surface (314) of the wear bushing (300) mates with the bushing profile (310) of the tubing head (202), a fluid-tight seal is created between the wear bushing (300) and the tubing head (202).

The tubing head (202) may be made out of any material known in the art that is durable, such as steel. The wear bushing (300) is also made out of any durable material known in the art, such as steel. The wear bushing (300) has a bushing inner surface (316) that defines an orifice (318).

Specifically, the orifice (318) is formed by the installation of the wear bushing (300) in the bushing profile (310) and the connection between the tubing head (202) and the casing head (206). The orifice (318) may be in hydraulic communication with the remainder of the well (200) when all intervening valves are in the open position.

In accordance with one or more embodiments, the bushing inner surface (316) has a consistent inner diameter and is smooth in design. Further, the inner diameter from the wear bushing (300) installed in the tubing head (202) to the casing head (206) stays the same to prevent turbulent flow. In other embodiments, the diameter of the orifice (318) may be tapered from the tubing head (202) to the casing head (206) without departing from the scope of the disclosure herein. Further, the bushing external surface (314) may also be tapered as shown in FIG. 3.

The bushing inner surface (316) is formed using a case hardening methodology. A case hardening methodology is a material processing method that is used to increase the hardness of the outer surface of a metal. Case hardening results in a thin layer of metal that is notably harder than the larger volume of metal underneath the hardened layer. Further, and in accordance with one or more embodiments, the bushing inner surface (316) has a 60-100-micron surface finish.

The bushing inner surface (316) may also be coated in an abrasion-resistant anti-friction coating. In accordance with one or more embodiments, the case-hardened polished finish creates a conducive flow path that enables the frac fluid (128) flow to remain in a laminar state. A typical polished surface of industry standard polished bore receptacles may be used. In other embodiments, a double stack debris barrier is installed on the bushing external surface (314) and is located between the wear bushing (300) and the bushing profile (310) when the wear bushing (300) is installed in the tubing head (202).

The double stack debris barrier includes a first debris barrier (320) and a second debris barrier (322). The debris barriers (320, 322) may be any type of debris barrier known in the art, such as an appropriately sized mesh, gauze, screen, etc. The debris barriers (320, 322) are designed to prevent debris ingress or accumulation between the wear bushing (300) and the bushing profile (310). For example, the frac fluid (128) may include an amount of proppant. The proppant may be prevented from entering and damaging the bushing profile (310) due to the presence of the debris barriers (320, 322). Further, the debris barriers (320, 322) allow pressure equalization between barrier stacks which eliminates the risk of hydraulic lock and pockets of differential pressure.

In further embodiments, the bushing inner surface (316) includes a running profile (324). In other words, a running profile (324) is machined into the bushing inner surface (316) of the wear bushing. The running profile (324) may cause that portion of the orifice (318) to deviate from the diameter of the remainder of the orifice (318), but the remainder of the orifice (318) may be a consistent diameter, as shown in FIG. 3. The term "running" is not meant to be limiting and the running profile (324) of the wear bushing (300) may be used to both install and uninstall the wear bushing (300) into/from the tubing head (202).

Figure 4:
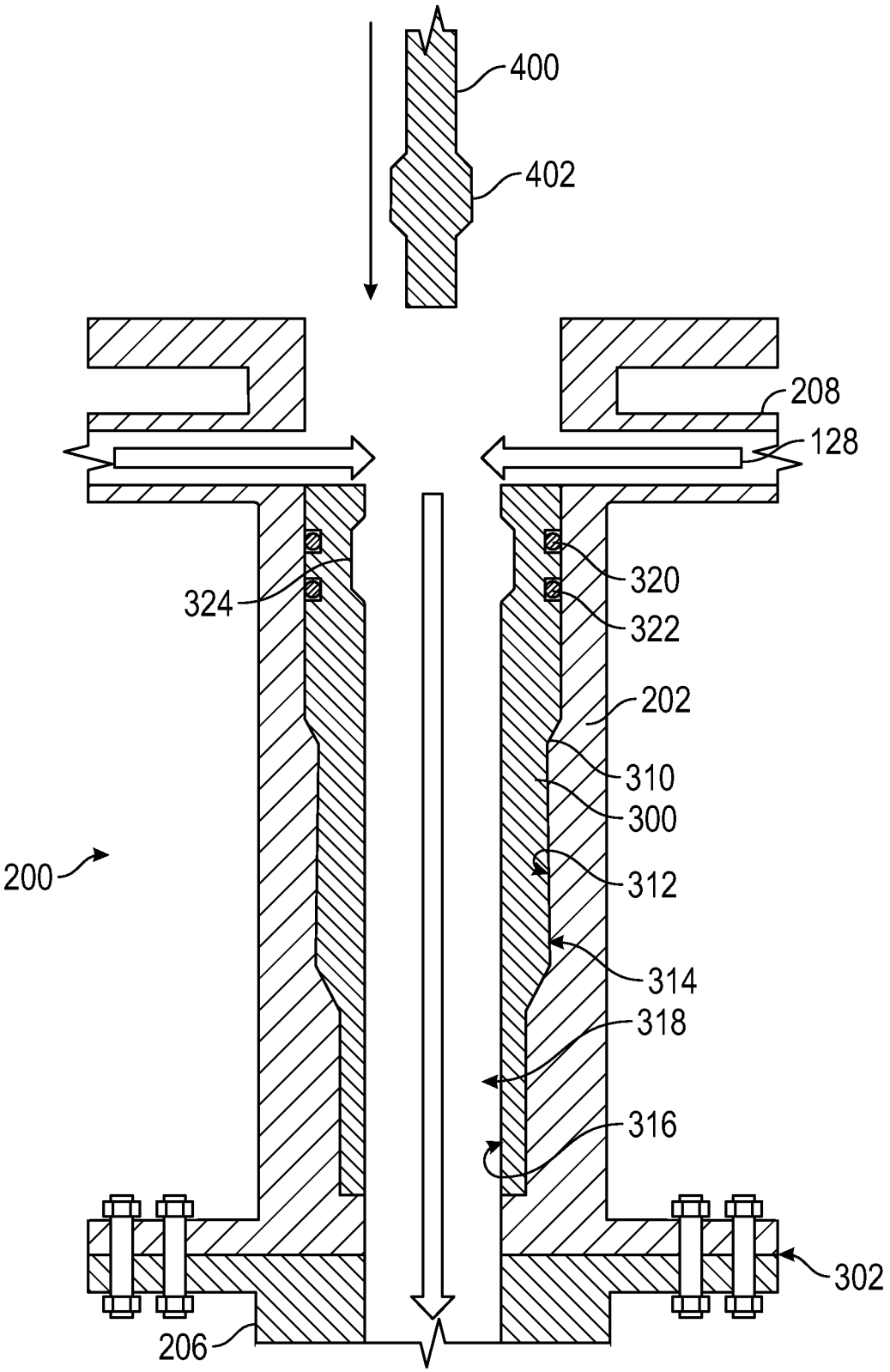
FIG. 4 shows a running tool having a corresponding running profile being run into the tubing head in accordance with one or more embodiments.

FIG. 4 shows a running tool (400) having a corresponding running profile (402) being run into the tubing head (202) in accordance with one or more embodiments. Components of FIG. 4 that are the same as or similar to components shown in FIGS. 1-3 have not been redescribed for purposes of readability and have the same design and function as outlined above.

The running tool (400) may be used to both install and uninstall the wear bushing into/from the bushing profile (310) of the wear bushing (300). In order for the running tool (400) to be able to enter the tubing head (202), the cap (304) must be removed, and the second bolted connection (306) must be disconnected. The running profile (324) of the wear bushing (300) and the corresponding running profile (402) of the running tool (400) are designed to mate such that the running tool (400) is located inside of the wear bushing (300). The running tool (400) may be an industry standard latch type pulling tool. Further, the running profile (324) may be a fishing profile that is robust and is resistant to erosion.

In accordance with one or more embodiments, the corresponding running profile (402) and the running profile (324) may mate with one another by running the running tool (400) into the wear bushing (300) with the corresponding running profile (402) located flush within the running tool (400). Once the running tool (400) is in position, a signal may be sent to the running tool (400) to allow the corresponding running profile (402) to jut out from the running tool (400) and mate with the running profile (324) of the wear bushing (300).

Once the running profile (324) and the corresponding running profile (402) are engaged, the running tool (400) may be able to move the wear bushing (300). In particular, the running tool (400) may be able to move the wear bushing (300) into or out of the tubing head (202). The running tool (400) may be lowered into or pulled from the tubing head (202) using any type of lift system such as wireline/slickline, coiled tubing, a snubbing unit, a drilling unit, a crane, etc.

Figure 5:
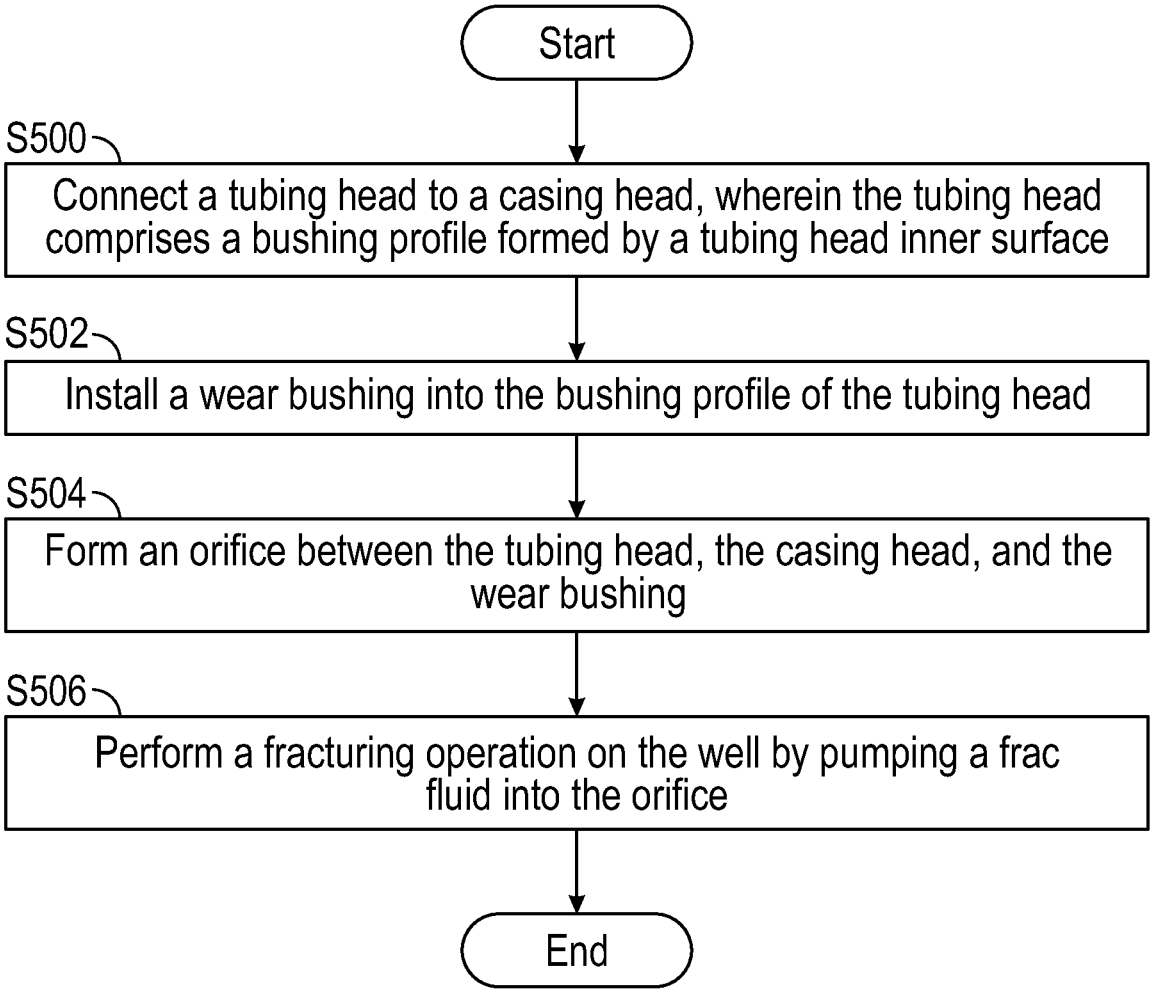
FIG. 5 shows a flowchart in accordance with one or more embodiments.

FIG. 5 shows a flowchart in accordance with one or more embodiments. The flowchart outlines a method for performing a fracturing operation on a well (200) through a tubing head (202). While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In step 500, a tubing head (202) is connected to a casing head (206), wherein the tubing head (202) comprises a bushing profile (310) formed by a tubing head inner surface (312). In accordance with one or more embodiments, the tubing head (202) is connected to the casing head (206) using a first bolted connection (302) which includes inserting bolts into bolt holes and securing the bolts using nuts. As explained above, the bushing profile (310) is equivalent to the tubing hanger profile that is machined into the tubing head inner surface (312) such that a tubing hanger may land out in the tubing head (202) after a string of production tubing is run into a fractured well (200).

In step 502, a wear bushing (300) is installed into the bushing profile (310) of the tubing head (202). The wear bushing (300) has a bushing external surface (314) and a bushing inner surface (316). The bushing external surface (314) is machined to match the bushing profile (310) such that the bushing external surface (314) may mate with the bushing profile (310) machined into the tubing head inner surface (312).

In further embodiments, the wear bushing (300) includes a double stack debris barrier consisting of a first debris barrier (320) and a second debris barrier (322). The debris barriers (320, 322) are installed on the wear bushing (300) and are located between the wear bushing (300) and the tubing head inner surface (312) (i.e., the bushing profile (310)). The debris barriers (320, 322) prevent debris from accessing the bushing profile (310).

In step 504, an orifice (318) is formed between the tubing head (202), the casing head (206), and the wear bushing (300). The bushing inner surface (316) defines a portion of the orifice (318). The orifice (318) is formed when once the wear bushing (300) is installed in the tubing head (202) and the tubing head (202) is connected to the casing head (206). The bushing inner surface (316) may have a 60-100-micron surface finish, may have been formed using a case hardening methodology, and may be coated in an abrasion resistant anti-friction coating.

The wear bushing (300) may be installed in the bushing profile (310) of the tubing head (202) using a running tool (400). The running tool (400) may mate with the wear bushing (300) through a corresponding running profile (402) of the running tool (400) and a running profile (324) of the wear bushing (300). Specifically, a running profile (324) may be machined into the bushing inner surface (316).

In one or more embodiments, the wear bushing (300) is installed on the running tool (400) using the running profile (324) and the corresponding running profile (402). The running tool (400) mated with the wear bushing (300) is run into the tubing head (202) to mate the bushing external surface (314) with the bushing profile (310).

Once the wear bushing (300) is installed in the tubing head (202), the running tool (400) may be disconnected from the wear bushing (300) by retracting the corresponding running profile (402) into the running tool (400) and removing the running tool (400) from the tubing head (202). In further embodiments, the wear bushing (300) may be removed from the tubing head (202) by running the running tool (400) into the wear bushing (300) and mating the running profile (324) of the wear bushing (300) with the corresponding running profile (402) of the running tool (400). Once the components are mated, the running tool (400) and the wear bushing (300) may be pulled from the tubing head (202).

In step 506, a fracturing operation is performed on the well (200) by pumping a frac fluid (128) into the orifice (318). Specifically, one or more frac lines (136) may be installed to the wing (208) of the tubing head (202). A frac fluid (128) may be pumped from the frac line (136) into the orifice (318) using the wing (208). The frac fluid (128) may enter the downhole portion (i.e., the underground portion) of the well (200) and fracture the formation.

This fracturing operation is performed through the tubing head (202) without damaging the tubing head (202) due to the installation of the wear bushing (300). Once the fracturing operation is completed on the well (200), the wear bushing (300) may be removed using the methodology described above.

With the wear bushing (300) removed, the plugs (118) may be drilled out using any means in the art such as coiled tubing, a snubbing unit, a drilling rig, etc. Once the plugs (118) are drilled out, the production tubing, including any other production equipment such as a pump or sand separators, is run into the fractured well (200). Once the entire length of the production tubing is run into the well (200), the tubing hanger may be landed into the tubing head (202) by mating the tubing hanger with the bushing profile (310).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system for performing a fracturing operation in a well having a casing head, the system comprising:

a tubing head, connected to the casing head, and comprising a tubing head inner surface machined to mate with a tubing hanger, wherein the tubing hanger is a surface extending portion of a production tubing and the production tubing comprises a conduit for production fluid to flow from a formation to a surface location;

a bushing profile formed by the tubing head inner surface of the tubing head;

a wear bushing having a bushing external surface, wherein the bushing external surface is tapered, and the bushing profile is correspondingly tapered causing the bushing profile and the bushing external surface to mate and allow the wear bushing to sit within the tubing head;

a running tool configured to install the wear bushing into the bushing profile of the tubing head using a cable connected to the running tool that lowers the running tool and wear bushing into the bushing profile of the tubing head;

an orifice formed by the installation of the wear bushing in the bushing profile and the connection between the tubing head and the casing head; and a frac fluid configured to be pumped into the well to fracture the formation though the orifice created by the wear bushing being installed in the tubing head, wherein the frac fluid is pumped through the wear bushing in a direction from the surface location to the formation.

2. The system of claim 1, further comprising a first debris barrier and a second debris barrier installed on the bushing external surface and located between the wear bushing and the bushing profile.

3. The system of claim 1, further comprising a running profile machined into a bushing inner surface of the wear bushing.

4. The system of claim 3, further comprising the running tool having a corresponding running profile configured to mate with the running profile of the wear bushing.

5. The system of claim 1, wherein a bushing inner surface of the wear bushing has a 60-100-micron surface finish.

6. The system of claim 5, wherein the bushing inner surface is formed using a case hardening methodology.

7. The system of claim 5, wherein the bushing inner surface is coated in an abrasion-resistant anti-friction coating.

8. The system of claim 1, further comprising a frac line connected to a wing of the tubing head, wherein the wing and the frac line are hydraulically connected to the orifice.

9. The system of claim 8, further comprising a frac fluid configured to be pumped into the well using the frac line.

10. The system of claim 1, further comprising a cap connected to the tubing head using a bolted connection.

11. A method for performing a fracturing operation in a well having a casing head, the method comprising:

connecting a tubing head to the casing head, wherein the tubing head comprises a bushing profile formed by a tubing head inner surface;

installing a wear bushing, having a bushing external surface, into the bushing profile of the tubing head, wherein the bushing external surface is tapered, and the bushing profile is correspondingly tapered causing the bushing profile and the bushing external surface to mate and allow the wear bushing to sit within the tubing head, wherein the wear bushing is installed into the bushing profile of the tubing head using a cable that lowers a running tool, connected to the wear bushing, into the bushing profile of the tubing head;

forming an orifice between the tubing head, the casing head, and the wear bushing;

performing a fracturing operation on the well by pumping a frac fluid into the orifice created by the wear bushing being installed in the tubing head, wherein the frac fluid is pumped through the wear bushing in a direction from a surface location to a formation; and installing a tubing hanger in the tubing head by mating the tubing hanger with the tubing head inner surface, wherein the tubing hanger is a surface extending portion of a production tubing and the production tubing comprises a conduit for production fluid to flow from the formation to the surface location.

12. The method of claim 11, wherein performing the fracturing operation further comprises preventing debris from accessing the bushing profile using a first debris barrier and a second debris barrier installed on the wear bushing between the wear bushing and the bushing profile.

13. The method of claim 11, wherein installing the wear bushing into the bushing profile of the tubing head further comprises mating a running profile of the wear bushing with a corresponding running profile of the running tool.

14. The method of claim 13, wherein installing the wear bushing into the bushing profile of the tubing head further comprises running the wear bushing mated with the running tool into the tubing head to mate a bushing external surface with the bushing profile.

15. The method of claim 14, wherein installing the wear bushing into the bushing profile of the tubing head further comprises disconnecting the wear bushing from the running tool and removing the running tool from the tubing head.

16. The method of claim 13, further comprising removing the wear bushing from the tubing head.

17. The method of claim 16, wherein removing the wear bushing from the tubing head further comprises running the running tool into the wear bushing.

18. The method of claim 17, wherein removing the wear bushing from the tubing head further comprises mating the running profile of the wear bushing with the corresponding running profile of the running tool.

19. The method of claim 18, wherein removing the wear bushing from the tubing head further comprises pulling the running tool mated with the wear bushing from the tubing head.

20. The method of claim 11, wherein performing the fracturing operation further comprises connecting a frac line to a wing of the tubing head and pumping the frac fluid from the frac line into the orifice using the wing.

* * * * *